US010914263B2

(12) United States Patent
Hauser

(10) Patent No.: US 10,914,263 B2
(45) Date of Patent: Feb. 9, 2021

(54) DETERMINATION OF A POINT IN TIME OF A PREDETERMINED STATE OF A FUEL INJECTOR

(71) Applicant: Continental Automotive GmbH, Hannover (DE)

(72) Inventor: Christian Hauser, Lappersdorf (DE)

(73) Assignee: VITESCO TECHNOLOGIES GMBH, Hannover (DE)

( * ) Notice: Subject to any disclaimer, the term of this patent is extended or adjusted under 35 U.S.C. 154(b) by 9 days.

(21) Appl. No.: 15/944,974

(22) Filed: Apr. 4, 2018

(65) Prior Publication Data

US 2018/0223763 A1 Aug. 9, 2018

Related U.S. Application Data

(63) Continuation of application No. PCT/EP2016/072350, filed on Sep. 21, 2016.

(30) Foreign Application Priority Data

Oct. 7, 2015 (DE) ..... 10 2015 219 383

(51) Int. Cl.
*F02D 41/00* (2006.01)
*F02D 41/24* (2006.01)
*F02D 41/20* (2006.01)

(52) U.S. Cl.
CPC ..... *F02D 41/2467* (2013.01); *F02D 41/20* (2013.01); *F02D 2041/2044* (2013.01);
(Continued)

(58) Field of Classification Search
CPC ..... F02D 2041/2055; F02D 2041/2044; F02D 2041/2051; F02D 2041/2058; F02D 41/2467; F02D 41/20; F02D 2200/063
See application file for complete search history.

(56) References Cited

U.S. PATENT DOCUMENTS 2,299,452 A * 10/1942 Bell ..... F02M 57/023 239/91
9,394,848 B2 * 7/2016 Puckett ..... F02D 41/3082
(Continued)

FOREIGN PATENT DOCUMENTS

CN 101846005 A 9/2010
CN 102639860 A 8/2012
(Continued)

OTHER PUBLICATIONS

International Search Report and Written Opinion dated Mar. 10, 2017 from corresponding International Patent Application No. PCT/EP2016/072350.
(Continued)

*Primary Examiner* — Phutthiwat Wongwian
*Assistant Examiner* — Sherman D Manley

(57) ABSTRACT

A method for determining a first time at which a fuel injector having a solenoid drive is in a first predetermined opening state. The method includes the following: (a) determining a second time at which the fuel injector is in a second predetermined state, (b) determining a stroke value of a moving component of the fuel injector, which stroke value corresponds to a movement path of the moving component which is covered when the fuel injector transitions between the first predetermined opening state and the second predetermined opening state, and (c) determining the first time at which the fuel injector is in the first predetermined opening state, on the basis of the second time and the stroke value. A method for actuating a fuel injector having a solenoid drive, an engine controller and a computer program.

20 Claims, 4 Drawing Sheets

(52) U.S. Cl.
CPC ..... *F02D 2041/2051* (2013.01); *F02D 2041/2055* (2013.01); *F02D 2041/2058* (2013.01); *F02D 2200/063* (2013.01)

(56) References Cited

U.S. PATENT DOCUMENTS

| | | | | |
|---|---|---|---|---|
| 10,371,084 | B2 * | 8/2019 | Kusakabe | F02D 41/34 |
| 2008/0148831 | A1 | 6/2008 | Kekedjian et al. | |
| 2011/0120423 | A1 * | 5/2011 | Borchsenius | F02D 41/2467 123/494 |
| 2011/0180044 | A1 * | 7/2011 | Fritsch | F02D 41/2096 123/478 |
| 2013/0327301 | A1 * | 12/2013 | Brandt | F02M 63/0026 123/478 |
| 2014/0240886 | A1 * | 8/2014 | Itaya | F02D 41/20 361/178 |
| 2014/0346244 | A1 * | 11/2014 | Russe | F02D 41/2096 239/4 |
| 2015/0068494 | A1 * | 3/2015 | Robart | F02D 41/2467 123/445 |
| 2015/0122000 | A1 * | 5/2015 | Willimowski | F02D 41/221 73/114.45 |
| 2016/0237937 | A1 * | 8/2016 | Kusakabe | F02D 41/247 |
| 2017/0145942 | A1 * | 5/2017 | Denk | F02D 41/2467 |
| 2018/0023720 | A1 * | 1/2018 | Traversa | F02M 65/00 251/129.15 |
| 2018/0080406 | A1 * | 3/2018 | Denk | F02D 41/402 |
| 2018/0216560 | A1 * | 8/2018 | Hauser | F02D 41/20 |
| 2018/0230932 | A1 * | 8/2018 | Hauser | F02D 41/2467 |
| 2019/0024602 | A1 * | 1/2019 | Hauser | F02D 41/20 |

FOREIGN PATENT DOCUMENTS

| | | | |
|---|---|---|---|
| CN | 103070279 | A | 5/2013 |
| CN | 103958870 | A | 7/2014 |
| DE | 19544207 | A1 | 6/1997 |
| DE | 102009027311 | A1 | 1/2011 |
| DE | 102009028650 | A1 | 2/2011 |
| DE | 102010063009 | A1 | 6/2012 |
| DE | 102011075935 | A1 | 11/2012 |
| DE | 102011076363 | A1 | 11/2012 |
| DE | 102011087418 | A1 | 6/2013 |
| JP | 2015063928 | A | 4/2015 |
| WO | 2014/131540 | A1 | 9/2014 |

OTHER PUBLICATIONS

Office Action dated May 12, 2016 from corresponding German Patent Application No. 10 2015 219 383.7.
Korean Office Action dated Feb. 26, 2019 for corresponding Korean Patent Application No. 10-2018-7012458.
Korean Notice of Allowance dated Jun. 27, 2019 for corresponding Korean Patent Application No. 10-2018-7012458.
Chinese Office Action dated Aug. 18, 2020 for the counterpart Chinese Application No. 201680058761.X.
Chinese Notice of Allowance dated Nov. 2, 2020 for the counterpart Chinese Application No. 201680058761.X.

* cited by examiner

DETERMINATION OF A POINT IN TIME OF A PREDETERMINED STATE OF A FUEL INJECTOR

CROSS-REFERENCE TO RELATED APPLICATIONS

This application claims the benefit of PCT Application PCT/EP2016/072350, filed Sep. 21, 2016, which claims priority to German Patent Application 10 2015 219 383.7, filed Oct. 7, 2015. The disclosures of the above applications are incorporated herein by reference.

FIELD OF THE INVENTION

The present invention relates to the technical field of actuating fuel injectors. In particular, the present invention relates to a method for determining a first time at which a fuel injector having a solenoid drive is in a first predetermined opening state. The present invention further relates to a method for actuating a fuel injector having a solenoid drive, wherein the actuation is based on a first time which is determined according to the invention. The present invention furthermore relates to an engine controller and to a computer program which are designed to carry out the method according to the invention.

BACKGROUND OF THE INVENTION

In order to inject fuel into a combustion chamber, such as a cylinder for example, a fuel injector such as, for example, a solenoid valve or a solenoid injector may be used. A solenoid injector (also called a coil injector) of this kind has a coil which generates a magnetic field when current flows through the coil, as a result of which a magnetic force is exerted on an armature so that the armature moves in order to cause opening or closing of a nozzle needle or of a closure element for opening or closing the solenoid valve. If the solenoid valve or the solenoid injector has a so-called idle stroke between the armature and the nozzle needle, or between the armature and the closure element, a movement of the armature does not also lead to a movement of the closure element or nozzle needle immediately, but rather only after a movement of the armature by the magnitude of the idle stroke has been completed.

When a voltage is applied to the coil of the solenoid valve, electromagnetic forces move the armature in the direction of a pole piece or pole shoe. After overcoming the idle stroke, the nozzle needle or the closure element likewise moves owing to mechanical coupling (e.g. mechanical contact) and, with a corresponding shift, opens injection holes for the supply of fuel into the combustion chamber. If current further flows through the coil, the armature and nozzle needle or closure element continue to move until the armature reaches or stops against the pole piece. The distance between the stop of the armature on a carrier of the closure element or the nozzle needle and the stop of the armature on the pole piece is also called the needle stroke or working stroke. In order to close the fuel injector, the exciter voltage which is applied to the coil is switched off and the coil is short-circuited, so that the magnetic force is dissipated. The coil short-circuit causes a reversal of polarity of the voltage owing to the dissipation of the magnetic field which is stored in the coil. The level of the voltage is limited by a diode. The nozzle needle or closure element, including the armature, is moved to the closing position owing to a return force which is provided, for example, by a spring. The idle stroke and the needle stroke are run in reverse order here.

The time at which the needle movement begins in the event of opening of the fuel injector (also called OPP1) is dependent on the magnitude of the idle stroke. The time at which the needle or the armature stops against the pole piece (also called OPP2) is dependent on the magnitude of the needle stroke or working stroke. Injector-specific time variations in the beginning of the needle movement (opening) and the end of the needle movement (closing) may result in different injection quantities given identical electrical actuation.

According to the prior art, the abovementioned times (and further relevant) times which correspond to specific opening states are determined in various ways. Therefore, for example, the time OPP2 at which the needle stops against the pole piece, is determined fairly accurately by detecting a feedback signal in the coil voltage or the coil current. However, the time OPP1 at which the idle stroke is overcome and mechanical coupling is established between the armature and the needle is critical for beginning injection in a hydraulic manner. This time is usually indirectly determined by a fixed correlation (on the basis of the needle stroke) being assumed between OPP2 and OPP1.

However, it has been established that, for example, the needle stroke of a fuel injector may change during the service life or during the operating period due to running-in processes or wear, for example settling of components. This may lead to corresponding faults when indirectly determining, for example, OPP1 since the assumed correlation with OPP2 is no longer applicable.

SUMMARY OF THE INVENTION

The present invention is based on the object of specifying an improved method for indirectly determining a time at which a fuel injector is in a predetermined state, in order to thereby allow precise and reliable actuation of the fuel injector.

This object is achieved by the subjects of the independent patent claims. Advantageous embodiments of the present invention are described in the dependent claims.

A first aspect of the invention describes a method for determining a first time at which a fuel injector having a solenoid drive is in a first predetermined opening state. The described method includes the following: (a) determining a second time at which the fuel injector is in a second predetermined state, (b) determining a stroke value of a moving component of the fuel injector, which stroke value corresponds to a movement path of the moving component which is covered when the fuel injector transitions between the first predetermined opening state and the second predetermined opening state, and (c) determining the first time at which the fuel injector is in the first predetermined opening state, on the basis of the second time and the stroke value.

The described method is based on the finding that precise (indirect) determination of a first time at which the fuel injector is in a first opening state is achieved in that a second time at which the fuel injector is in a second predetermined state and a stroke value are determined. The stroke value corresponds to a movement path which a moving component of the fuel injector covers between the first predetermined opening state and the second predetermined opening state. In other words, the stroke value corresponds to a movement path which is covered by the moving component during a transition by the fuel injector from the first opening state to the second opening state of the fuel injector or from the second opening state to the first opening state of the fuel injector. The first time may therefore occur both before and also after the second time. A duration of the movement of the moving component (that is to say the duration of the transition from the first/second opening state to the second/first opening state) is determined or estimated by virtue of knowing the stroke value. The first time may then be determined on the basis of this duration and the second time.

In this document, the term "opening state" designates, in particular, a state which occurs during an injection process, that is to say during the opening phase, injection phase or closing phase of the fuel injector. Examples which may be mentioned include (i) start of electrical actuation or start of the armature movement (also called OPP0), (ii) occurrence of the mechanical coupling between the armature and the nozzle needle, or beginning of the needle movement on opening (also called OPP1), (iii) stopping of the needle against the pole piece, or end of the opening process (also called OPP2), (iv) initiating the closing process or beginning of the needle movement on closing (also called OPP3), (v) end of the mechanical coupling between the needle and armature, or end of the needle movement on closing (also called OPP4), and (vi) end of the armature movement on closing (also called OPP5).

In this document, "moving component" designates, in particular, a moving element or component in the fuel injector, the movement of the moving element or component leading to or contributing to a change in the opening state of the fuel injector.

According to one exemplary embodiment of the invention, determining the stroke value includes the following: (a) detecting a data set which represents a relationship between the interlinked magnetic flux and current intensity in the solenoid drive in the event of actuation of the fuel injectors, and (b) analysing the data set in order to determine the stroke value.

Detecting the data set is preferably carried out in the event of relatively slow actuation of the fuel injector, that is to say that, for example, a voltage of between 5 V and 15 V, in particular approximately 10 V, is applied to the solenoid drive. It is thus possible for fewer eddy currents, which may be disadvantageous for analysing the data set, to be generated.

Detecting the data set is carried out regularly at suitable times, so that up-to-date data is always used for determining the stroke value.

The current intensity is preferably directly measured. The values of the electrical voltage and of the electrical coil resistance (in the solenoid drive) are additionally required in order to determine the corresponding values of the interlinked magnetic flux.

According to a further exemplary embodiment of the invention, analysing the data set includes forming a characteristic curve on the basis of the data set and detecting shifts in the profile of the characteristic curve.

In this context, "shifts" are intended to be understood to mean, in particular, a distance between parts of the characteristic curve which run in parallel.

According to a further exemplary embodiment of the invention, determining the first time includes the following: (a) determining a difference between the stroke value and a reference stroke value, (b) determining a corrected second time on the basis of the second time, the difference and a correction factor, and (c) determining the first time on the basis of the corrected second time and a predetermined relationship between the first opening state and the second opening state.

In this document, the "reference stroke value" designates, in particular, a stroke value which is specified by the manufacturer or a stroke value which is measured when installing the fuel injector.

In other words, the deviation of the stroke value from the reference stroke value is determined and a corrected second time is determined from the deviation, that is to say the time at which the fuel injector would have been in the second opening state if the stroke value were equal to the reference stroke value. The corrected second time is then used, together with the known relationship between the first and the second opening state, for determining the first time.

According to a further exemplary embodiment of the invention, the first predetermined opening state of the fuel injector is the start of an opening phase, and the second predetermined opening state is the end of the opening phase.

In other words, in this embodiment, the first opening state is equal to the above-described opening state OPP1, and the second opening state is equal to the above-described opening state OPP2.

According to a further exemplary embodiment of the invention, the moving component is a needle (nozzle needle), and the stroke value is a needle stroke value.

The duration of the transition from OPP1 to OPP2 is determined by the needle stroke. If the needle stoke increases, the duration is correspondingly extended, and vice versa.

In a similar way, the needle stroke could also be used in conjunction with the above-described opening states OPP3 and OPP4 in the closing process. More precisely, the time at which the opening state OPP4 occurs could be determined from the time which corresponds to the open state OPP3 and the needle stroke.

It should be noted that other states and/or stroke values come into consideration for the method according to the invention. Therefore, for example, the transition from OPP0 to OPP1 and also the transition from OPP4 to OPP5 are characterized by the idle stroke.

A second aspect of the invention describes a method for actuating a fuel injector having a solenoid drive. The described method includes the following: (a) carrying out a method for determining a first time at which the fuel injector is in a first predetermined opening state according to the first aspect or one of the above exemplary embodiments, and (b) actuating the fuel injector on the basis of the determined first time, wherein, in particular, a duration between the application of a boost voltage for opening the fuel injector and the application of a voltage for closing the fuel injector is reduced or increased if it is determined that the first time occurs later or earlier than a reference time.

By way of this method, accurate control of the precise injection quantity is achieved in a simple and reliable manner by using the method according to the first aspect.

A third aspect of the invention describes an engine controller for a vehicle which is designed for using a method according to the first and/or second aspect and/or one of the above exemplary embodiments.

This engine controller allows accurate control of the precise injection quantities of the individual fuel injectors in a simple and reliable manner by using the method according to the first aspect.

A fourth aspect of the invention describes a computer program which, when executed by a processor, is designed to carry out the method according to the first and/or the second aspect and/or one of the above exemplary embodiments.

Within the meaning of this document, a computer program of this kind is equivalent to the concept of a program element, a computer program product and/or a computer-readable medium which contains instructions for controlling a computer system, in order to coordinate the manner of operation of a system or of a method in a suitable manner, in order to achieve the effects associated with the method according to the invention.

The computer program is implemented as a computer-readable instruction code in any suitable programming language, such as JAVA, C++ etc. for example. The computer program may be stored on a computer-readable storage medium (CD-Rom, DVD, Blu-ray disk, removable drive, volatile or non-volatile memory, integral memory/processor etc.). The instruction code may program a computer or other programmable devices, such as in particular a control unit for an engine of a motor vehicle, in such a way that the desired functions are executed. Furthermore, the computer program may be provided in a network such as, for example, the Internet, from which a user may download it as required.

The invention is realized both by means of a computer program, i.e. software, and also by means of one or more specific electrical circuits, i.e. as hardware or in any desired hybrid form, i.e. by means of software components and hardware components.

It should be noted that embodiments of the invention have been described with reference to different subjects of the invention. In particular, some embodiments of the invention are described by way of method claims and other embodiments of the invention are described by way of apparatus claims. However, it becomes immediately clear to a person skilled in the art upon reading this application that, unless explicitly stated otherwise, in addition to a combination of features which are associated with one type of subject matter of the invention, any combination of features which are associated with different types of subjects of the invention is also possible.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

Further advantages and features of the present invention may be gathered from the following exemplary description of a preferred embodiment.

DETAILED DESCRIPTION OF THE PREFERRED EMBODIMENT

The following description of the preferred embodiment(s) is merely exemplary in nature and is in no way intended to limit the invention, its application, or uses.

It should be noted that the embodiments described below are merely a limited selection of possible variant embodiments of the invention.

Figure 1:
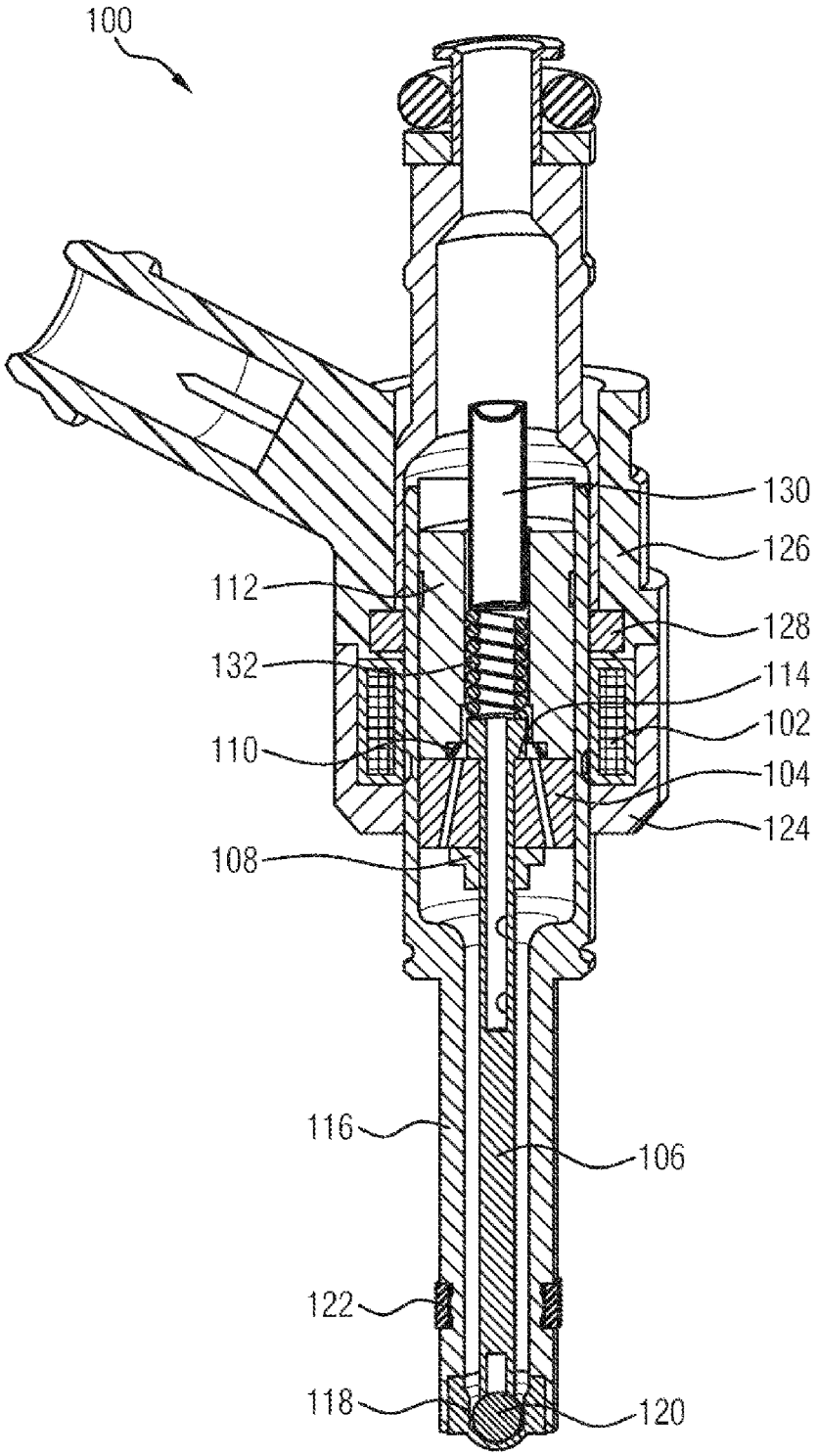
FIG. 1 shows a fuel injector with a solenoid drive.

FIG. 1 shows a sectional view of a fuel injector 100 with a solenoid drive (solenoid injector). The injector 100 includes, in particular, a solenoid drive with a coil 102 and an armature 104. When a voltage pulse is applied to the coil 102, the magnetic armature 104 moves in the direction of the wide part of the nozzle needle 106 and then, after overcoming the idle stroke 114 (against the force of the spring 110), presses the nozzle needle upward against the spring forces exerted by the springs 110 and 132 until the armature 104 stops against the pole shoe 112. When the voltage pulse is ended, the armature 104 and the nozzle needle 106 move back down again to the starting position on the hydro disk 108.

The solenoid injector 100 shown in FIG. 1 has several features which are known per se and are only of negligible significance for the present invention; therefore, these are not described in detail. These features include, in particular, valve body 116, integrated seat guide 118, ball 120, seal 122, housing 124, plastic 126, disk 128, metal filter 130 and calibration spring 132.

Figure 2:
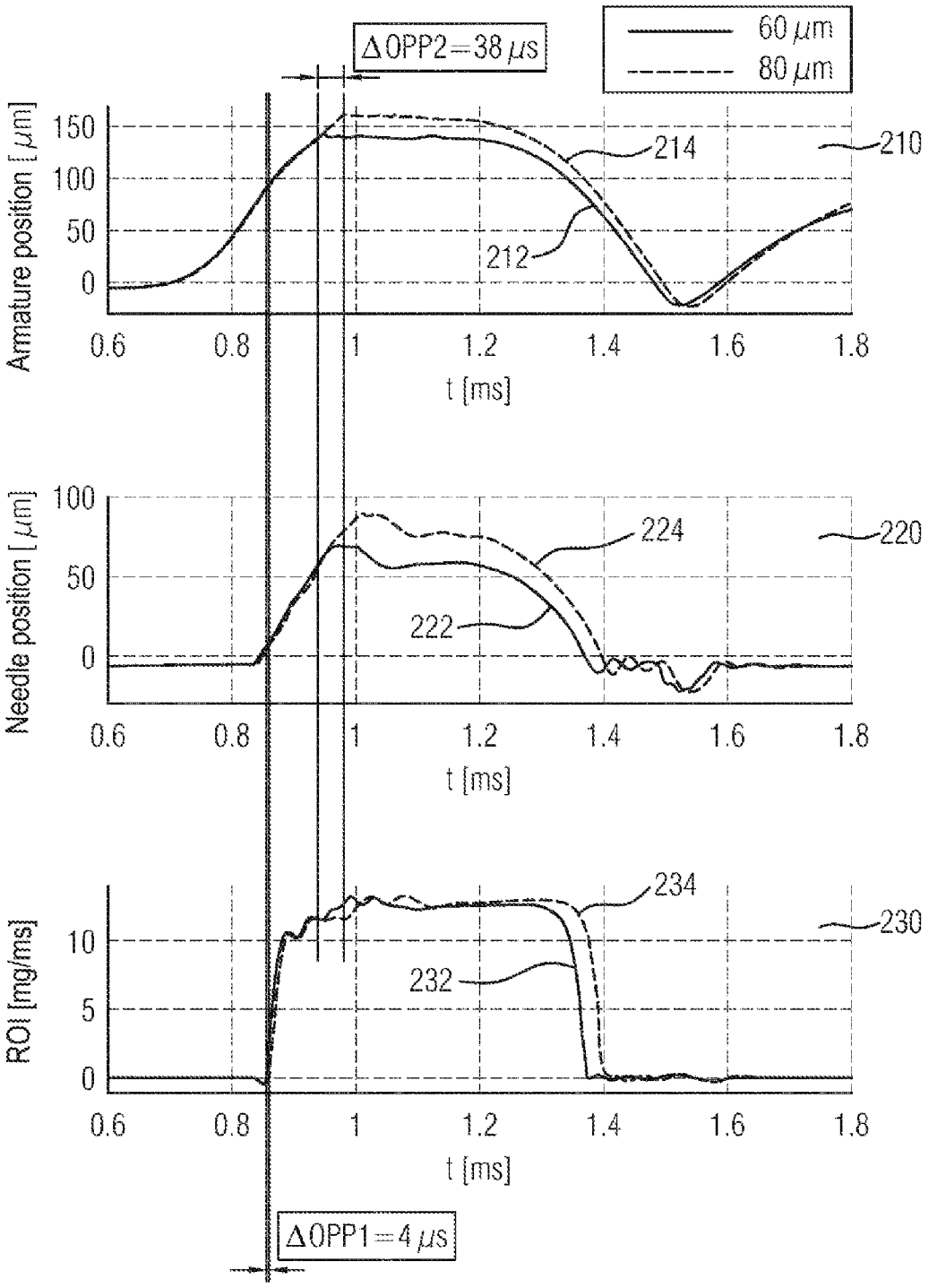
FIG. 2 shows an armature position, needle position and rate of injection as functions of time for two fuel injectors with a different needle stroke.

FIG. 2 shows armature position 212, 214, needle position 222, 224 and rate of injection (ROI) 232, 234 as functions of time for two fuel injectors with a different needle stroke. Apart from the needle strokes, the two fuel injectors are identical and are electrically actuated in an identical manner.

Specifically, the upper image 210 shows the armature position 212 (curve with a solid line) for a fuel injector with a 60 μm needle stroke and the armature position 214 (curve with a dashed line) for a fuel injector with an 80 μm needle stroke. The middle image 220 shows the needle position 222 (curve with a solid line) for the fuel injector with a 60 μm needle stroke and the needle position 224 (curve with a dashed line) for the fuel injector with an 80 μm needle stroke. The lower image 230 shows the rate of injection (ROI) 232 (curve with a solid line) for the fuel injector with a 60 μm needle stroke and the rate of injection 234 (curve with a dashed line) for the fuel injector with an 80 μm needle stroke.

Images 210, 220 and 230 show that the difference in the needle stroke of 20 μm leads to a difference of 38 μs between the times at which the opening state OPP2 (end of the needle movement) is reached, that is to say ΔOPP=38 μs. Secondly, the difference between the times at which the opening state OPP1 (beginning of the needle movement) is reached is only 4 μs, that is to say ΔOPP1=4 μs. This is attributed to the fact that the magnetic force is initially slightly different owing to the magnetic starting air gap. If the OPP1 time is then estimated simply on the basis of detection of the OPP2 time, as was frequently done up until now, this may lead to a deviation of 34 μs, that is to say more than eight times too much.

Furthermore, it is clearly shown in image 230 that the total injection quantity is considerably greater when the needle stroke is 80 μs. Although the actuation is the same, the injection operation ends considerably later specifically in this case, cf. curve 234.

These deviations may be compensated for by the method according to the invention by the actual needle stroke being regularly determined and being taken into account when a (first) time is determined on the basis of another (second) time. The method according to the invention will be described in more detail below in conjunction with FIG. 4.

Figure 3:
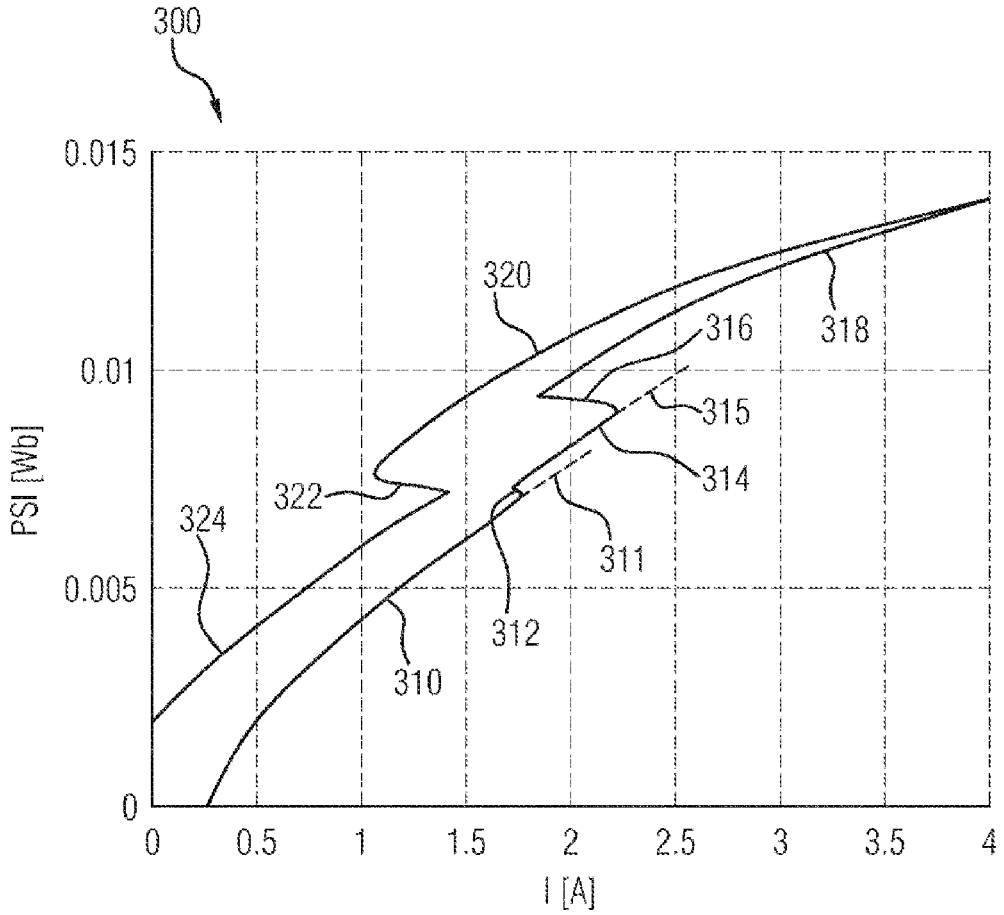
FIG. 3 shows a ψ-I characteristic curve (PSI-I characteristic curve) for determining, according to the invention, a stroke value for a fuel injector.

FIG. 3 shows a characteristic curve (PSI-I characteristic curve) 300 for determining, according to the invention, a stroke value for a fuel injector, such as the fuel injector 100 shown in FIG. 1 for example. The characteristic curve 300 is substantially made up of two curve elements, wherein the lower curve element is made up of curve sections 310, 312, 314, 316 and 318 and corresponds to opening of the fuel injector 100. The upper curve element is made up of curve sections 320, 322 and 324 and corresponds to closing of the fuel injector 100. Two shifts of the curved profile take place along the lower curve element.

The first shift is created on account of the idle stroke, i.e. by the armature being moved from its inoperative position until it makes contact with the needle and then being braked or stopped. In other words, the magnetic force is firstly built up along the curve section 310, then the armature moves along the curve section 312 as far as the needle (idle stroke), where it remains stationary along the curve section 314 while a further magnetic force is built up. The second shift is created on account of the needle stroke, i.e. by both the armature and also the needle together moving until they come to a standstill when the armature stops on the pole piece. The movement of the armature and the needle runs along the curve section 316 and a further build-up of the magnetic force takes place along the curve section 318.

The idle stroke and the needle stroke is determined, as described further below, by determining the shifts, for example by detecting the distance between tangents 311 (that is to say extrapolation of the curve section 310) and the curve sections 314 or between tangents 315 (that is to say extrapolation of the curve section 314) and the curve section 318.

The closing process proceeds in a similar manner, but in reverse: The magnetic force is firstly reduced along the curve section 320. The needle and the armature then together move away from the pole piece and then the armature moves away from the needle as far as its inoperative position on the hydro disk. These two movements run along the curve section 322. Finally, the magnetic force is further reduced along the curve section 324.

In order to record the characteristic curve 300, the injector 100 is driven with a low voltage, e.g. 10 V, so that the idle stroke movement and the needle movement are separated into two distinct movements. Low magnetic forces are created due to the low drive voltage. The idle stroke movement takes place (along the curve section 312) after the force of the spring 110 has been overcome. The armature 104 moves toward the needle 106 and remains inoperative together with the needle 106 since the force of the calibration spring 132 counteracts a movement. Owing to a further increase in the magnetic force, the force of the calibration spring 132 is overcome and the armature 104 and the needle 106 move (along the curve section 316) until the armature 104 comes to rest against the pole shoes 112.

The stroke value is given by the differences in the curve section before the movement and in the curve section after the movement. In other words, the idle stroke may be determined by determining a flow difference (given a suitable current intensity) between the tangent 311 (that is to say the extrapolated continuation of the curve section 310) and the curve section 314. In the same way, the needle stroke is determined by determining a flow difference between the tangent 315 (that is to say the extrapolated continuation of the curve section 314) and the curve section 318. A possible evaluation would be, for example, ascertaining the difference in the PSI value at 2 A (0.0004 Wb) and then multiplication by a factor. In this example, the factor 125000 μm/Wb would then result in an idle stroke of 50 μm (0.0004 Wb*125000 μm/Wb=50 μm).

The characteristic curve 300 is determined by measuring the current which flows through the coil 102 and the voltage which is applied to the coil 102, and also by calculating the interlinked magnetic flux LP from the current, the voltage and the electrical resistance of the coil 102. The measured voltage u(t) is made up of a resistive component (i(t)*R) and an inductive component ($u_{ind}$(t)). Here, the inductive voltage is calculated from the time derivative of the interlinked magnetic flux, wherein ψ depends on the change in current i(t) and the air gap x(t).

$$u(t) = i(t)R + u_{ind}(t) = i(t)R + \frac{d\Psi(i,x)}{dt} = i(t)R + \left(\frac{d\Psi(i,x)}{di}\frac{di}{dt} + \frac{d\Psi(i,x)}{dx}\frac{dx}{dt}\right)$$

On slow actuation, the "magnetic" component of the induction due to a change in current is small.

$$u_{ind1} = \frac{d\Psi(i,x)}{di}\frac{di}{dt}$$

The "mechanical" part of the induction due to the armature movement then describes the strokes (idle stroke and/or working stroke) of the fuel injector.

$$u_{ind2} = \frac{d\Psi(i,x)}{dx}\frac{dx}{dt}$$

By transposition and integration, the interlinked magnetic flux may be calculated as follows:

$$\Psi = \int (u(t) - i(t)R)dt$$

Figure 4:
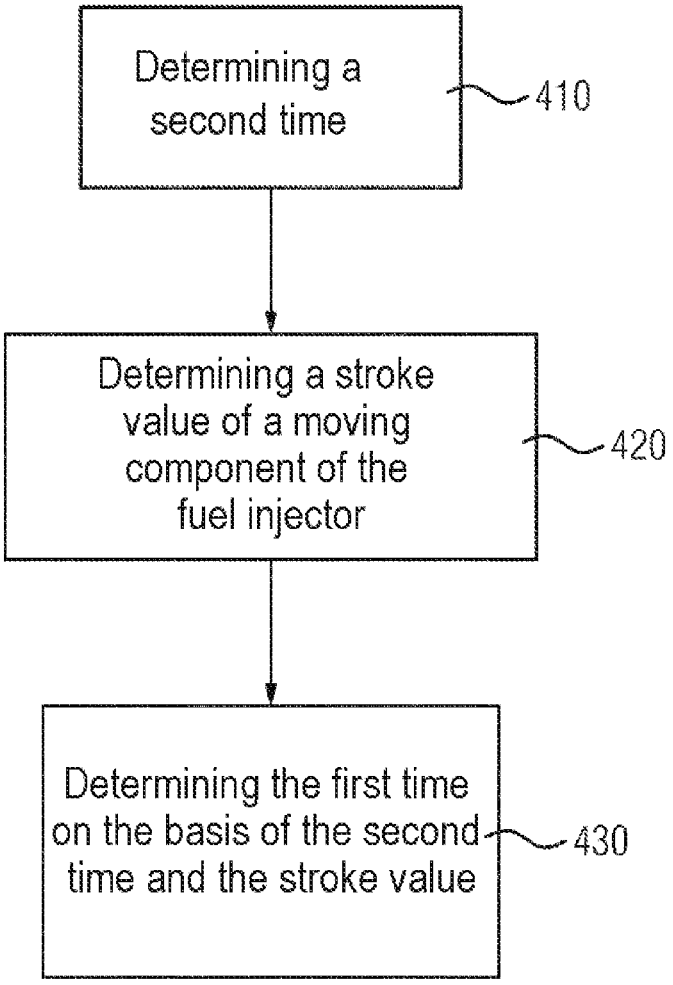
FIG. 4 shows a flowchart of a method according to the invention.

FIG. 4 shows a flowchart of a method according to the invention for determining a first time at which a fuel injector having a solenoid drive is in a first predetermined opening state. The first predetermined state may be, for example, OPP1.

A second time at which the fuel injector is in a second predetermined state is determined in step 410. The second predetermined state may be, for example, OPP2.

A stroke value of a moving component of the fuel injector, which stroke value corresponds to a movement path of the moving component which is covered when the fuel injector transitions between the first predetermined opening state and the second predetermined opening state, is determined in step 420. The stroke value may be, for example, the value of the needle stroke.

The first time at which the fuel injector is in the first predetermined opening state is then determined in step 430 on the basis of the second time and the stroke value.

The first time may preferably be such that a difference between the stroke value determined in step 420 and a reference stroke value (for example a stroke value which is prespecified by the manufacturer) is determined. In other words, the current deviation in the stroke value is determined. The determined second time is then corrected depending on the determined difference. This may be done, for example, using a correction factor $$T2k = T2 - k*D$$

Here, T2 is the second time, T2k is the corrected second time, k is the correction factor, and D is the difference.

With reference to the values shown in FIG. 2, this gives T2k=38 μs−1.7 μs/μm*20 μm=4 μs. The correction factor is k=34 μs/20 μm=1.7 μs/μm here.

After correction of the second time, the first time may then be determined using the known relationship between the two times, that is to say in the same way as if the needle stroke were equal to the reference value.

Overall, the present invention establishes a method which is simple and easy to implement and by way of which accurate injection quantities may be achieved depending on changes in the stroke value, for example owing to wear.

The description of the invention is merely exemplary in nature and, thus, variations that do not depart from the gist of the invention are intended to be within the scope of the invention. Such variations are not to be regarded as a departure from the spirit and scope of the invention.

LIST OF REFERENCE SYMBOLS

100 Fuel injector
102 Coil
104 Armature
106 Needle
108 Hydro disk
110 Spring
112 Pole shoe
114 Idle stroke
116 Valve body
118 Integrated seat guide
120 Ball
122 Seal
124 Housing
126 Plastic
128 Disk
130 Metal filter
132 Calibration spring
210 Image
212 Armature position as a function of time
214 Armature position as a function of time
220 Image
222 Needle position as a function of time
224 Needle position as a function of time
230 Image
232 Rate of injection as a function of time
234 Rate of injection as a function of time
300 ψ-I characteristic curve
310 Curve section
311 Tangent
312 Curve section
314 Curve section
315 Tangent
316 Curve section
318 Curve section
320 Curve section
322 Curve section
324 Curve section
410 Method step
420 Method step
430 Method step

What is claimed is:

1. A method for determining a first time at which a fuel injector having a solenoid drive is in a first predetermined opening state, the method comprising:
providing a fuel injector; and
providing at least one moving component being part of the fuel injector;
determining a second time at which the fuel injector is in a second predetermined opening state;
moving the at least one moving component on a movement path from the first predetermined opening state to the second predetermined opening state;
determining a stroke value of the at least one moving component of the fuel injector, which the stroke value corresponds to the movement path of the at least one moving component which is covered when the fuel injector transitions between the first predetermined opening state and the second predetermined opening state;
determining a first time at which the fuel injector is in the first predetermined opening state, on the basis of the second time and the stroke value,
wherein determining the stroke value further comprising:
providing a data set which represents a relationship between the interlinked magnetic flux and the current intensity in the solenoid drive in the event of actuation of the fuel injectors;
detecting the data set; and
analysing the data set in order to determine the stroke value.

2. The method of claim 1, further comprising the steps of:
analysing the data set by forming a characteristic curve of the stroke value on the basis of the data set, and detecting shifts in the profile of the characteristic curve.

3. The method of claim 1, determining the first time further comprising the steps of:
providing a reference stroke value;
providing a corrected second time;
determining a difference between the stroke value and the reference stroke value;
determining the corrected second time on the basis of the second time, the difference and a correction factor, and
determining the first time on the basis of the corrected second time and a predetermined relationship between the first opening state and the second opening state.

4. The method of claim 1, further comprising the steps of:
providing an opening phase such that the first predetermined opening state of the fuel injector is the start of the opening phase, and the second predetermined opening state is the end of the opening phase.

5. The method of claim 4, further comprising the steps of:
providing the at least one moving component to be a needle, and the stroke value is a needle stroke value.

6. A method for actuating a fuel injector having a solenoid drive, comprising the steps of:
providing a fuel injector;
providing a solenoid drive being part of the fuel injector;
providing a reference time;
providing a boost voltage for opening the fuel injector;
determining a first time at which the fuel injector is in a first predetermined opening state, wherein the first predetermined state is an idle stroke location of the fuel injector comprising the steps of:
providing at least one moving component being part of the fuel injector;
determining a second time at which the fuel injector is in a second predetermined opening state;
determining a stroke value of the at least one moving component of the fuel injector, which the stroke value corresponds to a movement path of the at least one moving component which is covered when the fuel injector transitions between the first predetermined opening state and the second predetermined opening state;

determining a first time at which the fuel injector is in the first predetermined opening state, on the basis of the second time and the stroke value;

actuating the fuel injector on the basis of the determined first time;

reducing a duration between the application of the boost voltage for opening the fuel injector and the application of a voltage for closing the fuel injector if it is determined that the first time occurs later than the reference time, or increasing duration between the application of the boost voltage for opening the fuel injector and the application of the voltage for closing the fuel injector if it is determined that the first time occurs earlier than the reference time.

7. The method of claim 6, determining the stroke value further comprising the steps of:

providing a data set which represents a relationship between the interlinked magnetic flux and the current intensity in the solenoid drive in the event of actuation of the fuel injectors;

detecting the data set;

analysing the data set in order to determine the stroke value.

8. The method of claim 7, further comprising the steps of:

analysing the data set by forming a characteristic curve of the stroke value on the basis of the data set, and detecting shifts in the profile of the characteristic curve.

9. The method of claim 6, determining the first time further comprising the steps of:

providing a reference stroke value;

providing a corrected second time;

determining a difference between the stroke value and the reference stroke value;

determining the corrected second time on the basis of the second time, the difference and a correction factor, and determining the first time on the basis of the corrected second time and a predetermined relationship between the first opening state and the second opening state.

10. The method of claim 6, further comprising the steps of:

providing an opening phase such that the first predetermined opening state of the fuel injector is the start of the opening phase, and the second predetermined opening state is the end of the opening phase.

11. The method of claim 10, further comprising the steps of:

providing the at least one moving component to be a needle, and the stroke value is a needle stroke value.

12. An engine controller for a vehicle, which engine controller is designed to determine a first time at which a fuel injector having a solenoid drive is in a first predetermined opening state, comprising:

a fuel injector;

at least one moving component being part of the fuel injector, wherein the at least one moving component is moved from the first predetermined opening state to a second predetermined opening state along a movement path, wherein the first predetermined state is an idle stroke location of the at least one moving component and wherein a stroke value of the at least one moving component is determined with the engine controller wherein a second time at which the fuel injector is in a second predetermined opening state is determined, and the first time at which the fuel injector is in the first predetermined opening state is determined with the engine controller on the basis of the second time and the stroke value.

13. The engine controller for a vehicle of claim 12, further comprising:

a data set, the data set being analysed and detected to determine the stroke value;

wherein the data set represents a relationship between the interlinked magnetic flux and the current intensity in the solenoid drive in the event of actuation of the fuel injectors.

14. The engine controller for a vehicle of claim 13, wherein the data set is analysed by forming a characteristic curve of the stroke value on the basis of the data set, and detecting shifts in the profile of the characteristic curve.

15. The engine controller for a vehicle of claim 12, determining the first time further comprising the steps of:

providing a reference stroke value;

providing a corrected second time;

determining a difference between the stroke value and the reference stroke value;

determining the corrected second time on the basis of the second time, the difference and a correction factor; and determining the first time on the basis of the corrected second time and a predetermined relationship between the first opening state and the second opening state.

16. The engine controller for a vehicle claim 12, further comprising an opening phase, wherein the first predetermined opening state of the fuel injector is the start of the opening phase, and the second predetermined opening state is the end of the opening phase.

17. The engine controller for a vehicle claim 16, the at least one moving component further comprising a needle, and the stroke value is a needle stroke value.

18. The method of claim 2, wherein the stroke value is the time for the at least one moving component to move from the first predetermine opening state to the second predetermined opening state based upon the data set.

19. The method of claim 7, wherein the stroke value is the time for the at least one moving component to move from the first predetermine opening state to the second predetermined opening state based upon the data set.

20. The engine controller of claim 13, wherein the stroke value is the time for the at least one moving component to move from the first predetermine opening state to the second predetermined opening state based upon the data set.

* * * * *